United States Patent [19]

McNamara et al.

[11] Patent Number: 4,828,608

[45] Date of Patent: May 9, 1989

[54] PROCESS FOR ULTRAPURIFICATION OF INDIUM

[75] Inventors: Michael F. McNamara, Utica; James A. Slattery, Sauquoit, both of N.Y.; August F. Witt, Winchester, Mass.

[73] Assignee: Indium Corporation of America, Utica, N.Y.

[21] Appl. No.: 50,201

[22] Filed: May 14, 1987

[51] Int. Cl.[4] ..... C22B 9/04; C22C 3/00

[52] U.S. Cl. ..... 75/62; 75/63

[58] Field of Search ..... 75/62, 63, 85, 652 M; 266/207, 208

[56] References Cited

U.S. PATENT DOCUMENTS

| | | | |
|---|---|---|---|
| 2,901,342 | 8/1959 | Siemons | 75/63 |
| 3,086,856 | 4/1963 | Siebertz | 75/63 |
| 3,093,475 | 6/1963 | Dryer, Jr. | 75/63 |
| 3,163,523 | 12/1964 | Porter et al. | 75/652 M |
| 3,504,898 | 4/1970 | Stocks | 266/208 |
| 3,598,873 | 8/1971 | Bloch | 75/652 M |
| 3,764,297 | 10/1973 | Coad et al. | 266/208 |
| 4,287,030 | 9/1981 | Belsky et al. | 75/65 R |
| 4,410,357 | 10/1983 | Ganev et al. | 75/63 |
| 4,512,799 | 4/1985 | Mulcahy | 266/207 |
| 4,559,217 | 12/1985 | Adamski | 75/62 |

FOREIGN PATENT DOCUMENTS

| | | | |
|---|---|---|---|
| 0554854 | 3/1958 | Canada | 75/62 |
| 1160628 | 1/1964 | Fed. Rep. of Germany | 75/62 |
| 1382904 | 11/1964 | France | 75/63 |
| 0012806 | 7/1963 | Japan | 75/62 |
| 0139844 | 2/1961 | U.S.S.R. | 75/62 |
| 0139840 | 3/1961 | U.S.S.R. | 75/62 |

*Primary Examiner*—L. Dewayne Rutledge
*Assistant Examiner*—David Schumaker
*Attorney, Agent, or Firm*—Weingarten, Schurgin, Gagnebin & Hayes

[57] ABSTRACT

A method and apparatus for ultrapurification of indium and other metals having a wide liquid range and low vapor pressure. The purification method involves producing a small-diameter stream of liquified metal, directing this stream along a predetermined path while subjecting it to a high vacuum and heating it to vaporize volatile impurities, then collecting and solidifying the purified stream. The method is optimally practiced in the ultrahigh vacuum and substantially zero gravity environment of outer space. Apparatus for practicing the method in outer space employs a containerless refining zone in which the stream of liquid metal being purified is directed along a path defined by edges of thin guides fabricated of material which is not substantially wetted by the liquid metal. Heating of the liquid metal stream is accomplished via RF coils surrounding the guides defining the stream path. Upon collection, the purified metal stream may be further subjected to a secondary refining process. Earth-based embodiments of the method and apparatus are also disclosed.

19 Claims, 3 Drawing Sheets

PROCESS FOR ULTRAPURIFICATION OF INDIUM

FIELD OF THE INVENTION

This invention relates to the refining of metals, and more particularly to the high purity refining of indium and other materials having similar characteristics.

BACKGROUND OF THE INVENTION

There is an increasing need for high purity metals such as indium for use in the fabrication of semiconductor devices such as IMPATT diodes; MESFET, MISFET, and JFET transistors; and optoelectronic detectors and light emitters. With presently known techniques, indium can be commercially produced with nominal purity levels of six nines (99.9999%), but for some purposes this is not sufficient, and indium of seven nines purity is desirable.

Present processes of indium purification generally employ electrochemical, chemical, and vacuum baking techniques to remove impurities from the indium. The degree of purification which can presently be achieved is limited by atmospheric contamination and container contamination, as well as by limitations inherent in the present refining techniques.

The electrochemical purification steps can remove copper, tin, nickel and lead, but are not suited to removal of cadmium or thallium, at least to the levels of purity required. The chemical purification steps can remove the cadmium and thallium constituents. Vacuum baking is employed after the electrochemical and chemical purification steps to further reduce the level of volatile impurities present in the resultant material. However, present techniques do not permit refinement of indium to the high degree of purity required for many semiconductor and other applications.

The atmosphere in which the refining process occurs is a source of contamination, such contamination usually comprising submicron particles containing carbon, sulphur, silicon, and potassium. The crucible or other container employed in the refining process is also a source of contamination, usually in the form of elements derived from the container material, which typically has been pyrolytic graphite or boron nitride. The contaminants from this source have included boron, carbon, silicon and sulphur. Presently achievable vacuums also limit the reduction in impurity concentrations which can be achieved in the vacuum bake-out step of present processes.

SUMMARY OF THE INVENTION

In brief, the present invention provides apparatus and a process for the ultrapurification of indium and other materials having low vapor pressures at high temperatures, and a wide liquid range, namely, a low melting point and high boiling point. The invention is preferably practiced in an environment of very high vacuum and substantially zero gravity such as found in outer space.

In one embodiment, a stream of molten indium from a pumped molten indium supply is directed along a path, guided by a plurality of nonwettable guides which extend along the path. RF heater coils are provided along the path to provide induction heating and convective mixing of the molten stream to maintain the stream at an intended temperature during its flow along the path. The refinement is essentially containerless as the guides are as thin as practicable for the particular material employed in relation to the circumference of the molten stream. There is thus minimal contact between the stream and the guiding members, such that the opportunities for container contamination, as occurs in conventional refining processes, are substantially eliminated. The stream retains its integrity by surface tension, and in a substantially zero gravity environment the rate of flow of the stream is determined solely by the driving pressure of the pumped supply. The nonwetting guides are supported by a substantially open structure, and the heating coils are also of substantially open configuration such that the stream throughout its path remains exposed to the high vacuum environment. Impurities in the molten material evaporate preferentially, substantially aided by the high vacuum and also aided by the open structure through which the stream flows along its heated path. At the exit end of the containerless refining structure the stream is collected and cooled to its solid state.

The collection vessel includes cooling means for solidification of the entering stream. This vessel preferably is of substantially closed configuration except for an opening through which the stream enters, to shield the cooling indium from recontamination by submicron particles or other sources of contamination which may be present in the vicinity of the collection vessel.

The collection vessel may alternatively include means for secondary refinement such as zone refining. As an example, the collection vessel can include an exit orifice from which solidified indium is drawn as the purified indium from the containerless refining zone enters and is cooled in the collection chamber. In this instance the collection vessel includes heat shielding to isolate the heated refining zone from the collection zone, and magnetic shielding to isolate the collection zone from the magnetic fields caused by the induction coils. The refined molten stream entering the collection zone is cooled at a controlled rate to permit the impurities still present after the purification process to remain within the molten material while allowing the liquid material to crystallize without entrainment of the impurities within the melt.

The invention can be practiced in alternative embodiments under the normal gravity conditions of a terrestrial environment by providing a molten stream of indium which is guided along an elongated heated path within a high vacuum environment. The path is preferably formed of a plurality of path segments such as an array of channels formed in a nonwetting material, with the stream being conveyed from the exit end of each channel to the entrance end of the adjacent channel. The stream at the exit end of the last channel of the array enters a collection chamber for cooling and collection in similar manner to that described above. Alternatively, the collection chamber can include zone refining or other secondary refining means for further purification of the indium.

DESCRIPTION OF THE DRAWINGS

The invention will be more fully understood from the following detailed description taken in conjunction with the accompanying drawings, in which.

DETAILED DESCRIPTION

Figure 1:
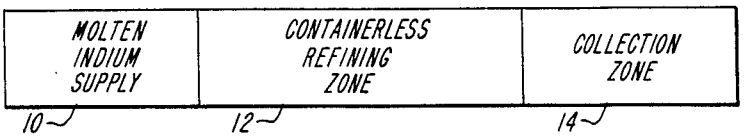
FIG. 1 is a block diagram of a refining system embodying the invention.

FIG. 1 shows a schematic block diagram of the refining apparatus of the invention. A supply 10 of molten indium is connected to one end of a containerless refining zone 12, the other end of which is connected to a collection zone 14.

Figure 2:
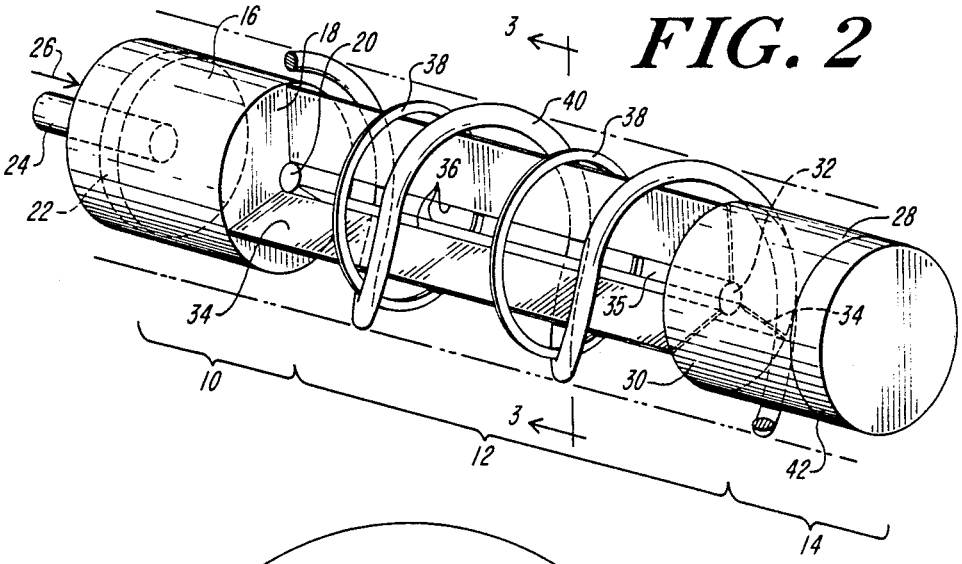
FIG. 2 is a pictorial view of a containerless refining structure in accordance with the invention.

FIG. 2 shows a structure for the refining apparatus, which includes a molten indium supply chamber 16 having a heater (not shown), and a wall 18 provided with an exit hole 20. chamber 16 is also provided with means for propelling a stream of molten indium from hole 20, such means including a piston 22 connected to a shaft 24, which is in turn connected to means (not shown) for exerting a force in the direction indicated by arrow 26. The stream preferably has a diameter less than approximately 2 cm. The apparatus also includes a collection chamber 28 having a wall 30 provided with an inlet hole 32.

Figure 3:
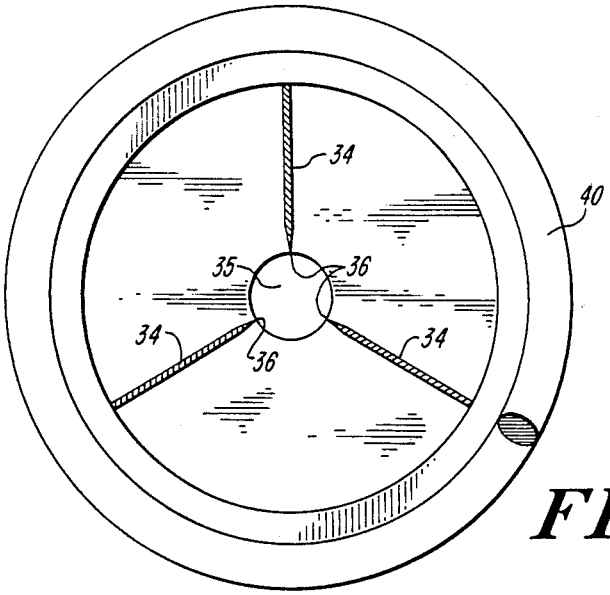
FIG. 3 is a sectional view taken along lines 3—3 of FIG. 2.

Refining zone 12 is disposed between indium supply 10 and collection zone 14 and includes a plurality of circumferentially spaced guides 34 which define a path 35 in alignment with exit hole 20 of indium supply 10 and inlet hole 32 of collection chamber 28. Guides 34 are preferably formed with relatively thin knife edges 36 and of material which is nonwettable by the molten indium. Guides 34 may be, for example, pyrolytic carbon or boron nitride. The guides are maintained in a substantially open configuration by a suitable supporting structure such as by rings 38 axially spaced along the path. FIG. 3 shows rings 38 supporting guides 34 and makes clear the manner in which the knife edges 36 define the path 35. A helical RF heater coil 40 is disposed along the axial path of refining zone 12. Heater coil 40 is connected to a suitable source of RF energy and is operative to heat the molten indium stream traversing the axial path to a temperature sufficient to maintain its molten state and volatilize impurities therefrom. Heater coil 40 and guides 34 are of substantially open construction to provide exposure of the molten stream to a high vacuum environment. Collection chamber 28 includes cooling means such as a cooled wall 42 onto which the molten stream entering inlet hole 32 impinges.

Possible materials for constructing the apparatus of the invention include quartz, alumina, beryllium oxide, pyrolytic graphite, boron nitride, titanium nitride, zirconium oxide, and other suitable materials coated or lined with pyrolytic carbon or boron nitride.

In operation, prepurified indium metal is contained in indium supply chamber 10 and melted by the application of heat provided by a suitable heat source. Pressure is applied to the molten indium by means of piston 22, causing it to flow out exit hole 20 in the form of a stream which is preferably less than about 2 cm in diameter. As the system is operated in outer space and in the effective absence of gravity, the indium stream tends to retain its shape due to its surface tension, and is directed along path 35 by the knife edges 36 of guides 34. The indium stream is maintained in a melted state at a temperature of 1000° C. to about 1400° C. by continued input of energy from RF coils 40 during this transit. As the system is exposed to the very high vacuum of outer space, materials more volatile than indium at the existing temperature and vacuum will tend to boil off into space, leaving the indium stream more pure than the indium of the indium supply. When the indium stream reaches inlet 32 of collection chamber 28 it enters the collection chamber and is ultimately cooled and solidified upon coming in contact with cooled wall 42. Collection chamber 28 is essentially closed except for inlet 32, to minimize possible reintroduction of any impurities which had boiled off from the indium stream during its transit of path 35 but remained in the near vicinity of the stream, and also to minimize the chance of contaminating the purified stream by inclusion of any microscopic or submicroscopic particles originating in the spacecraft and its associated equipment.

Figure 4A:
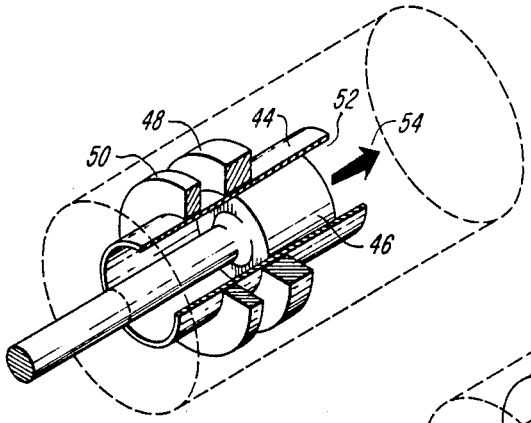
FIGS. 4A and 4B are diagrammatic representations of the collection zone including secondary refining means.

In its simplest embodiment, collection chamber 28 is basically a closed container having an inlet 32 and cooling means such as cooled wall 42 to solidify the liquid indium stream, as shown and discussed above. In an alternative embodiment shown in FIGS. 4A and 4B, however, further purification of the indium stream may be obtained by applying a secondary refinement such as zone refining in collection chamber 28. As shown in FIG. 4A, such zone refining may be accomplished by providing a sleeve 44, an initial plug of solidified indium 46 in sleeve 44, cooling means 48 surrounding sleeve 44, and optional heat and magnetic shielding 50 also surrounding sleeve 44 and located between entrance hole 32 and cooling means 48. Withdrawal means are provided for withdrawing solidified indium from sleeve 44 at its exit orifice 52 as shown by arrow 54.

Figure 4B:
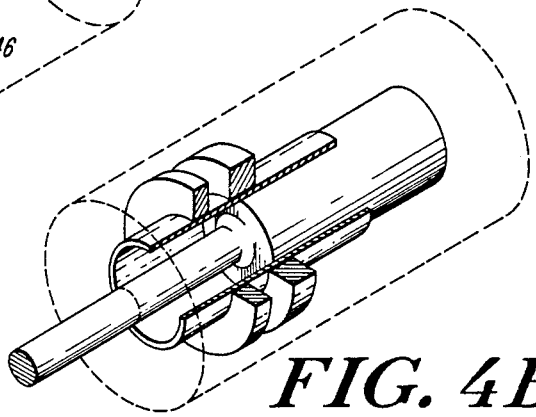

In operation, such secondary refining operates by cooling the incoming indium stream slowly in a controlled manner such that the solidifying indium preferentially excludes impurities, which remain in the melt just in front of the solidified indium plug 46. The solidified indium is withdrawn via exit orifice 52 at a rate which is essentially the same as the rate at which the liquid indium crystallizes. FIG. 4B shows the secondary refining apparatus of FIG. 4A after some indium has been deposited and indium plug 46 has been appropriately withdrawn.

Figure 5:
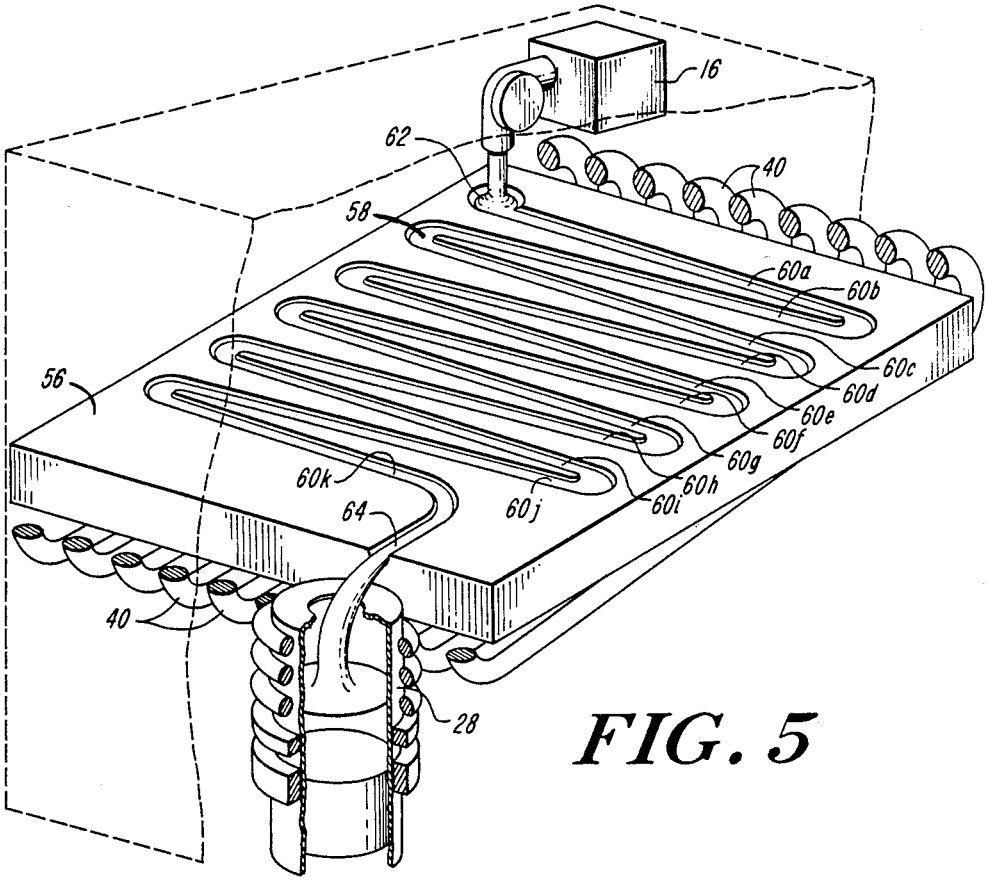
FIG. 5 is a pictorial view of an alternative embodiment of the refining zone.

FIG. 5 shows an alternative embodiment of the invention which is suitable for earth-based refining. A block 56 of nonwettable substrate material such as pyrolytic carbon or boron nitride is provided with a long channel 58 formed of a plurality of interconnected zigzag channel segments **60*a*–60*k*. Channel 58 is provided with an inlet 62 and an outlet 64. Inlet 62 is connected to a molten indium supply chamber 16 by suitable tubing, or indium supply chamber 16 is maintained in a position relative to block 56 and channel inlet 62 such that molten indium from the exit of supply 16 is delivered directly to channel inlet 62 without the need for connective tubing. Channel outlet 64 is similarly connected to a collection chamber 28 via suitable tubing, or collection chamber 28 is maintained in a position relative to channel outlet 64 such that molten indium leaving channel outlet 64 falls directly into collection chamber 28 without the necessity for any connecting tubing. The inlet to collection chamber 28 is in this alternative on the top of chamber 28, and chamber 28 may be simply provided with cooling means such as shown in FIG. 2 or may be further provided with secondary refining means such as zone refining apparatus, as shown in FIGS. 4A and 4B. The latter is illustrated in FIG. 5. Surrounding block 56 are RF coils 40 analogous to and serving the same function as the RF coils 40** shown in the space-based embodiment of the invention in FIG. 2.

In the embodiment shown in FIG. 5, a stream of molten indium from indium supply chamber 16 is caused to flow into inlet 62 of channel 58 in substrate block 56. Block 56 is oriented at a small angle relative to horizontal so that inlet 62 is higher than outlet 64, and the indium stream therefore flows through channel 58 under gravity. The indium stream is kept molten by means of energy supplied via RF coils 40, and the entire system is maintained in a vacuum chamber, indicated schematically in FIG. 5 by the dashed lines forming a cut-away container. The temperature of the molten stream is maintained in excess of 1000° C., preferably in the vicinity of 1400° C., though any temperature within the liquid range of indium will serve in particular cases, depending upon the impurities to be ultimately removed. The vacuum should be as good as can be obtained, generally at least $10^{-7}$ to $10^{-8}$ torr, and preferably better. As the hot liquid indium stream traverses channel 58 under a good vacuum, volatile impurities such as thallium and cadmium will tend to volatilize out. The resulting purified indium is collected in collection chamber 28, with or without secondary refining, as the solid metal.

Figure 6:
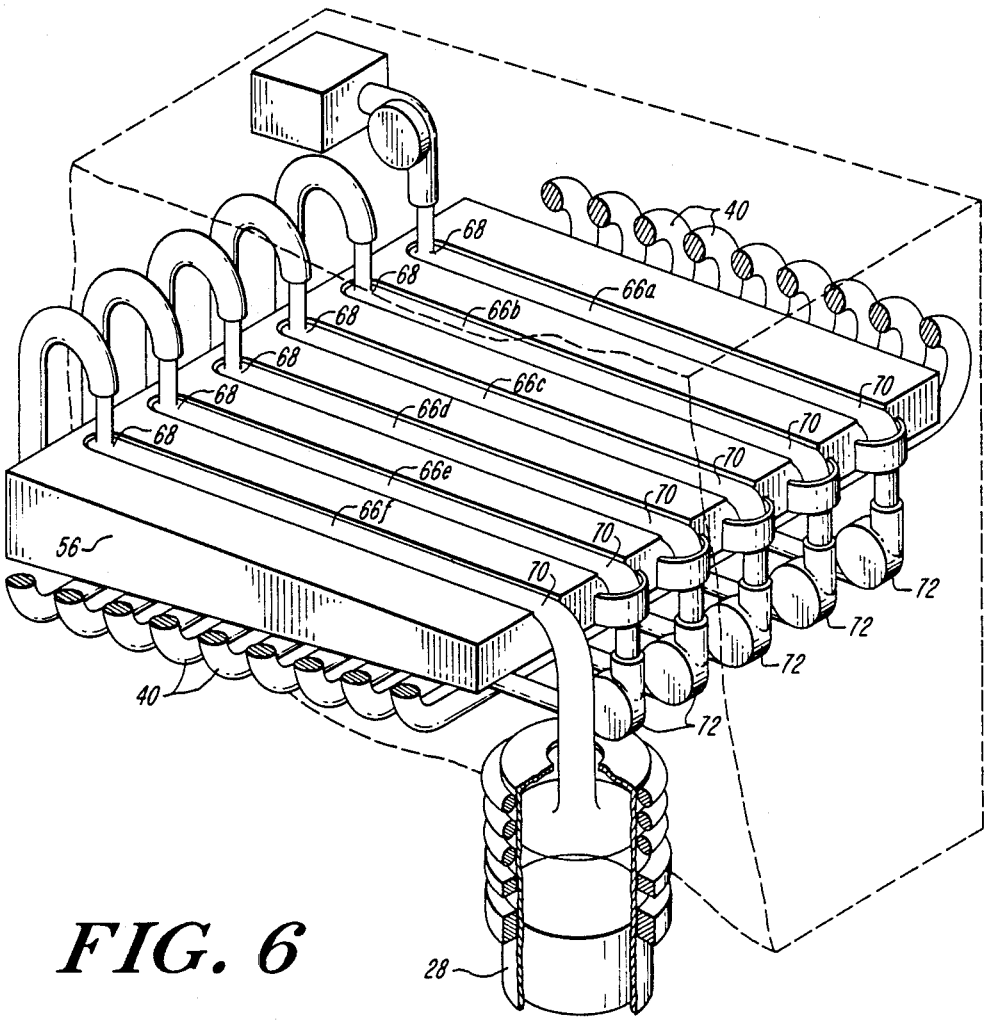
FIG. 6 is a further alternative embodiment of a refining zone in accordance with the invention.

In another alternative embodiment, shown in FIG. 6, a substrate block 56 is provided with a plurality of channels 66*a*–f, each of which has an inlet 68 and an outlet 70. Block 56 is again constructed of a nonwetting material such as boron nitride or pyrolytic carbon. At the outlet 70 of each of the channels 66 is a conveying means 72, a pump for example, for moving the liquid indium stream from the outlet of one channel to the inlet of the adjacent channel. A molten indium supply chamber 16 is connected to the inlet of the first channel 66*a* on block 56 by means of suitable tubing, or indium supply chamber 16 is simply maintained in a position such that the indium stream from supply chamber 16 enters channel 66*a* by gravity. Similarly, a collection chamber 28 is attached to outlet 70 of the last channel 66*f* by suitable tubing or is maintained in a suitable position relative to this channel outlet such that the molten indium stream flows into the collection chamber by gravity. The molten indium supply chamber 16 and the collection chamber 28 are essentially as described above, and collection chamber 28 may provide for a secondary refining, also as described above. RF coils 40 are provided around block 56 to maintain the molten indium stream at a desired temperature, generally in the vicinity of 1400° C. Again, the entire structure is contained in a suitable vacuum chamber having a vacuum of $10^{-7}$ to $10^{-8}$ torr or better, shown schematically in FIG. 6 by the dashed lines forming a cut-away container. In operation, as the molten stream traverses channels 66 volatile impurities such as cadmium and thallium will tend to be volatilized away, resulting in purified indium being collected in collection chamber 28.

The invention has been exemplified by the disclosure of certain apparatus and processes, but those skilled in the art will recognize that certain changes can be made without departing from the intended scope of the invention. Accordingly, the scope of the invention is to be limited only by the appended claims.

What is claimed is:

1. A method for refining metal, comprising the steps of:

providing a vacuum environment;

defining an elongated path having first and second ends and a length defined by the distance along said path between said ends, said path being capable of containing a stream of liquid metal and being in and substantially open to said vacuum environment;

producing a stream of liquid metal;

introducing said stream into the first end of said path;

causing said stream to transverse the length of said path while simultaneously heating said stream throughout its traverse of said path and exposing at least a substantial portion of said stream to vacuum as it traverses said path; and collecting and solidifying said stream as it leaves the second end of said path.

2. The method of claim 1 wherein said metal is indium.

3. The method of claim 1 wherein said stream is heated above approximately 1000° C. as it traverses said path.

4. The method of claim 3 wherein said stream is heated to a temperature of approximately 1400° C.

5. The method of claim 1 wherein said vacuum is at least $10^{-7}$ torr.

6. The method of claim 1 wherein said collecting and solidifying step further includes the step of subjecting said stream to a secondary refining process.

7. The method of claim 6 wherein said secondary refining process comprises zone refining.

8. The method of claim 1 wherein said stream is heated by induction.

9. The method of claim 1 wherein said path comprises a plurality of sequentially connected channel segments formed in a substrate made of a material which is substantially non-wettable by said liquid metal.

10. The method of claim 9 wherein said plurality of sequentially connected channel segments constitute a serpentine-shaped channel.

11. The method of claim 9 wherein said stream is pumped from the exit end of each channel segment to the entrance end of the succeeding channel segment.

12. The method of claim 9 wherein said channel segments are located substantially in one plane.

13. The method of claim 9 wherein said substrate comprises pyrolytic carbon or boron nitride.

14. The method of claim 1 wherein said stream of liquid metal is of substantially circular cross-section.

15. The method of claim 14 wherein said elongated path is defined by a plurality of guiding edges of a material that is substantially nonwettable by said liquid metal, said edges being thin relative to the diameter of said stream and being spaced circumferentially about said stream.

16. The method of claim 15 wherein each of said guiding edges has the shape of a knife edge.

17. The method of claim 15 wherein each of said guiding edges comprises pyrolytic carbon or boron nitride.

18. A method for refining metal, comprising the steps of:

producing a stream of liquid metal;

causing said stream to traverse an elongated channel comprising a plurality of sequentially connected channel segments formed in a substrate made of a material which is substantially non-wettable by said liquid metal;

simultaneously heating said stream throughout its traverse of said channel and exposing at least a substantial portion of said stream to vacuum as its traverses said channel; and collecting and solidifying said stream as it leaves said channel.

19. A method for refining metal, comprising the steps of:

producing a stream of liquid metal;

causing said stream to traverse an elongated path defined by a plurality of guiding edges of a material that is substantially nonwettable by said liquid metal, said edges being thin relative to the cross-section of said stream and being spaced about the periphery of said stream;

heating said stream and exposing it to vacuum throughout its traverse of said path; and collecting and solidifying said stream as it leaves said path.

* * * * *